United States Patent [19]

Sawamura

[11] Patent Number: 4,544,011

[45] Date of Patent: Oct. 1, 1985

[54] PLEAT SCREEN

[75] Inventor: Mamoru Sawamura, Gifu, Japan

[73] Assignee: Dowa Seishi Co., Ltd., Japan

[21] Appl. No.: 510,412

[22] Filed: Jul. 1, 1983

[51] Int. Cl.[4] ..... E06B 9/262; A47H 5/032

[52] U.S. Cl. ..... 160/84 R

[58] Field of Search ..... 160/84 R, 236, 278 D, 160/278 E, 278 F, 166

[56] References Cited

U.S. PATENT DOCUMENTS

| | | | |
|---|---|---|---|
| 2,320,852 | 6/1943 | DeFalco | 160/84 R |
| 3,946,788 | 3/1976 | van Muyen | 160/84 R |
| 4,422,492 | 12/1983 | Bledsoe | 160/84 R |
| 4,444,238 | 4/1984 | Adler | 160/84 R |

FOREIGN PATENT DOCUMENTS

| | | | |
|---|---|---|---|
| 1434209 | 10/1968 | Fed. Rep. of Germany | 160/84 R |

*Primary Examiner*—Peter M. Caun
*Assistant Examiner*—Cherney S. Lieberman
*Attorney, Agent, or Firm*—Leydig, Voit & Mayer

[57] ABSTRACT

A pleat screen includes a screen sheet having a plurality of zig-zag pleats and vertically foldable and unfoldable by an operator cord. At least one tape extends vertically through the pleats. Holders are mounted on the tape in engagement with selected ones of the pleats for supporting, from below, the selected pleats to prevent the pleats from being lowered due to their own weight when the screen sheet is vertically unfolded.

4 Claims, 8 Drawing Figures

PLEAT SCREEN

BACKGROUND OF THE INVENTION

1. Field of the Invention

The present invention relates to a screen for use as a window shade or a sun blind in a window frame, for example, to provide soft natural lighting, and more particularly to a pleat screen composed of a screen sheet having a multiplicity of horizontal pleats arranged side by side in the vertical direction.

2. Description of the Prior Art

Pleat screens usually comprise a screen sheet as of paper or cloth pleated into zig-zag folds, and are vertically foldable and unfoldable by a lift cord to open and close the window. When the pleat screen hanging from a window frame is unfolded, however, the pleats are spaced by their own weight more widely at an upper portion of the screen than they are spaced at a lower portion thereof, resulting in an unsightly appearance. This tendency becomes stronger as the screen is hung for a longer period of time. In such a situation, upper pleats go elongated or stretched completely so that the pleat screen can easily curve back and forth as a whole under the pressure of winds applied.

SUMMARY OF THE INVENTION

It is an object of the present invention to provide a pleat screen having means for preventing a pleated screen sheet from being elongated downwardly due to gravity so that the pleats will be spaced at substantially equal intervals at all times anywhere across the pleat screen.

Another object of the present invention is to provide a pleat screen whichhas a sightly appearance and highly resistant to wind pressure.

Still another object of the present invention is to provide a pleat screen having a screen sheet composed of a pair of horizontally juxtaposed screen sheet members which are easily connectable to each other so that the screen sheet can readily be increased in width.

A still further object of the present invention is to provide a pleat screen having simply constructed tapes and holding means for protecting a screen sheet from being elongated.

A pleat screen comprises a screen sheet having a plurality of pleats vertically foldable and unfoldable, at least one tape extending vertically along the screen sheet between upper and lower ends thereof, and holding means acting between selected ones of the pleats and the tape for keeping the plurality of pleats vertically spaced at substantially equal distances.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
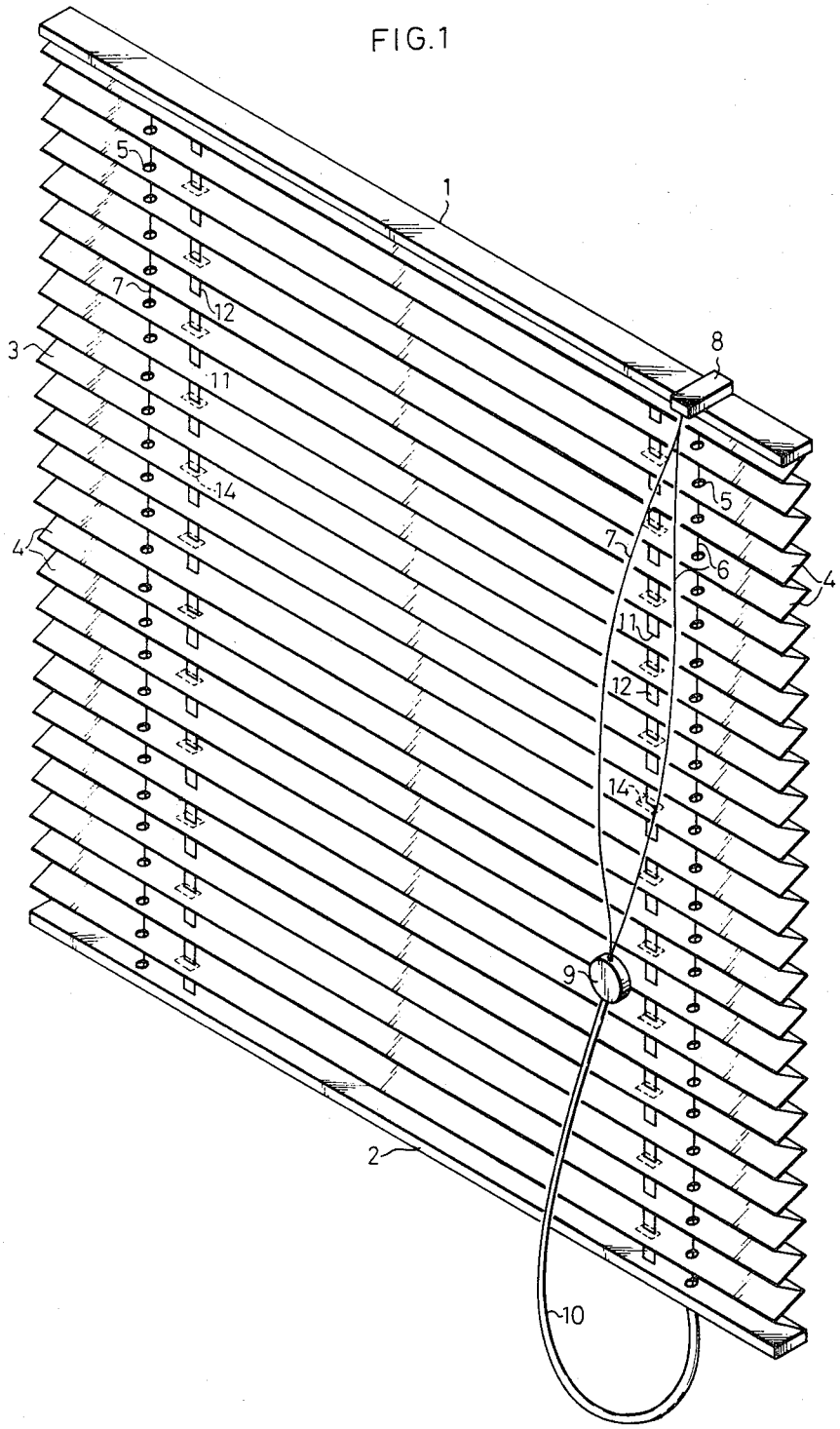
FIG. 1 is a perspective view of a pleat screen as unfolded according to an embodiment of the present invention.

As shown in FIG. 1, a pleat screen according to an embodiment of the present invention comprises a screen sheet 3 joined to and extending between an upper hanging frame 1 and a lower frame 2. The screen sheet 3 is made of synthetic paper prepared by treating plain paper with resin. The screen sheet 3 has a multiplicity of horizontal pleats 4 equal in width and arranged side by side in the vertical direction. The upper hanging frame 1 is hung by brackets (not shown) from a window frame, for example.

Each of the pleats 4 has a pair of apertures 5, 5 in opposite end portions thereof, there being a pair of lift cords 6, 7 extending respectively through the apertures 5 and having ends fixed to the lower frame 2. One of the lift cords 6 extends through a guide 8 mounted on an end of the hanging frame 1 and is dependent from the guide 8 exteriorly of the pleat screen. The other lift cord 7 extends through the hanging frame 1 and is dependent from the guide 8 exteriorly of the pleat screen. The other ends of the lift cords 6, 7 are connected by a grip 9 to an operator cord 10 having an end secured to the lower frame 2. When the operator cord 10 is pulled all the way, the lower frame 2 is raised to fold the pleat screen. When the operator cord 10 is pulled after the pleat screen has been folded, a brake (not shown) in the guide 8 is released to allow the pleat screen to be unfolded to the position shown in FIG. 1.

Each pleat 4 has a pair of slits 11, 11 adjacent to and inwardly of the apertures 5, 5, respectively. As better shown in FIGS. 2 and 3, a flat tape 12 extends through each vertically aligned row of slits 11 and has a multiplicity of slots 13 spaced at given equal intervals. The flat tape 12 has opposite ends secured to the upper and lower frames 1, 2.

Figure 2:
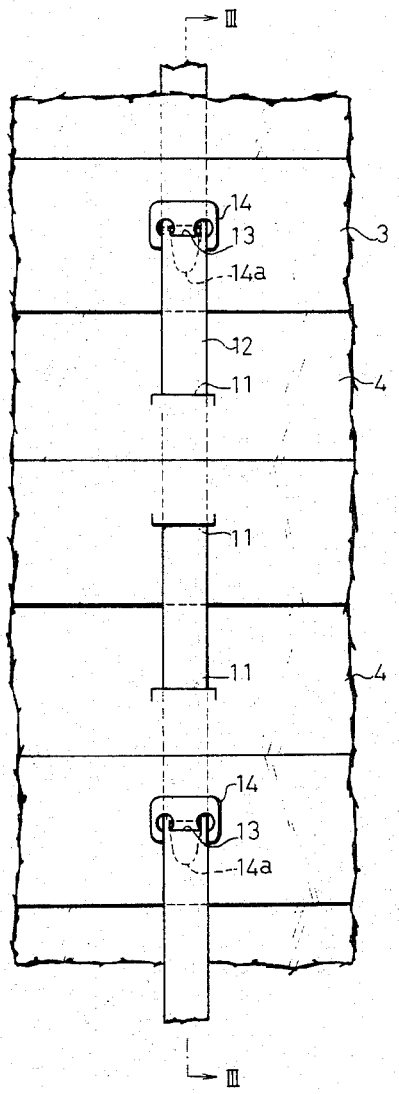
FIG. 2 is an enlarged fragmentary rear elevational view of the pleat screen shown in FIG. 1.
Figure 3:
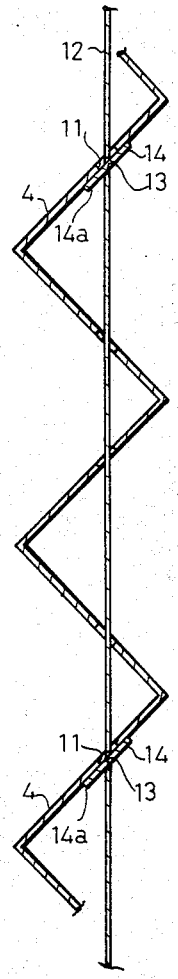
FIG. 3 is a cross-sectional view taken along line III—III of FIG. 2.

A plurality of holders 14 (FIG. 4) of synthetic resin are mounted on each tape 12 behind the screen sheet 3, as shown in FIG. 3. Each of the holders 14 has a locking tongue 14*a* inserted into one of the slots 13 as illustrated in FIG. 2. Thus, the holders 14 are retained on the tape 12 respectively at the slots 13. The holders 14 have upper surfaces held in abutment against lower backs of the pleats 4, respectively, such that when the pleat screen is unfolded, the pleats 4 are prevented from being spaced apart beyond prescribed intervals.

The pleat screen thus constructed can be opened or closed by the operator cord 10 as described above. When the operator cord 10 is pulled at the time all of the pleats 4 are folded, the brake in the guide 8 is released to allow the lower frame 2 to descend by gravity until the pleats 4 are unfolded as shown in FIG. 1. If the pleat screen had no holders, then the pleats 4 would be subjected to a greater weight at an upper portion of the pleat screen than at a lower portion thereof. Therefore, the pleats 4 would be more spaced from each other at the upper portion than would be at the lower portion. The pleat screen would then be out of balance in appearance.

According to the pleat screen of the present invention, the pleats 4 are prevented by the holders 14 on the tapes 12 from being spaced apart beyond substantially equal distances under the weight of the lower frame 2 and the screen sheet 3 per se. As a consequence, the pleats 4 remain substantially equally spaced vertically all the way across the pleat screen. The pleat screen of the invention is not subjected to any tendency to be vertically elongated or stretched to an unrestorable condition at the upper portion even when the pleat screen is put to continued use for an long period of time. All of the pleats 4 are kept uniformly spaced and give a balanced configuration.

Since the holders 14 are positioned on the back of the screen sheet 3, they are concealed from view on the face of the screen sheet 3 when the screen sheet 3 is unfolded, and hence do not impair the sightly appearance of the plate screen. The tapes 12 have discontinued portions appearing on the face of the screen sheet 3 to provide an ornamental effect.

Figures 4, 5, 8:
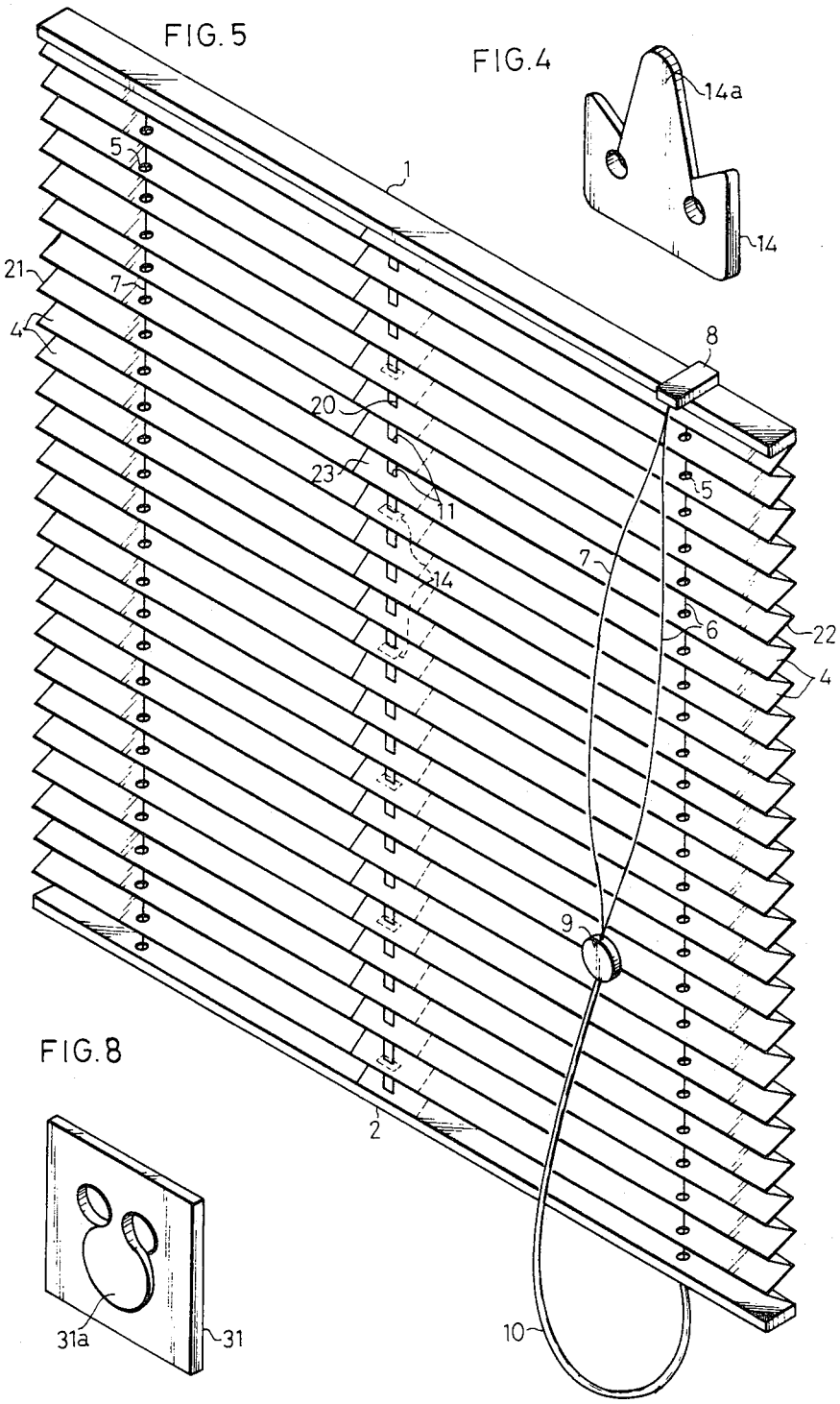
FIG. 4 is an enlarged perspective view of a holder.
FIG. 5 is a perspective view of a pleat screen according to another embodiment of the present invention.
FIG. 8 is an enlarged perspective view of a holder according to another embodiment.

FIG. 5 illustrates a pleat screen according to another embodiment of the present invention.

The pleat screen shown in FIG. 5 has a screen sheet composed of a pair of screen sheet members 21, 22 joined side by side to each other in overlapping relation at lateral ends thereof. Each of the screen sheet members 21, 22 is substantially the same as the screen sheet 3 shown in FIG. 1 as to construction and material. A single tape 20 extends through a vertically aligned row of slits 11 defined in end portions 23 of the screen sheet members 21, 22 which overlap one another. The tape 20 has opposite ends secured to an upper hanging frame 1 and a lower frame 2. A plurality of holders 14 are affixed to the tape 20 at equal intervals in abutting engagement with the lower surfaces of certain pleats 4 of the screen sheet members 21, 22. The holders 14 serve to prevent the pleats 4 from being spread apart beyond predetermined distances. The tape 20 also serves to interconnect the two screen sheet members 21, 22. The pleat screen of this construction is of an increased width that can be achieved through a relatively simple arrangement. Where more than two screen sheet members are arranged side by side, tapes 25 should be provided which extend vertically through respective overlapping ends 23 of the screen sheet members which are interconnected.

Figure 6:
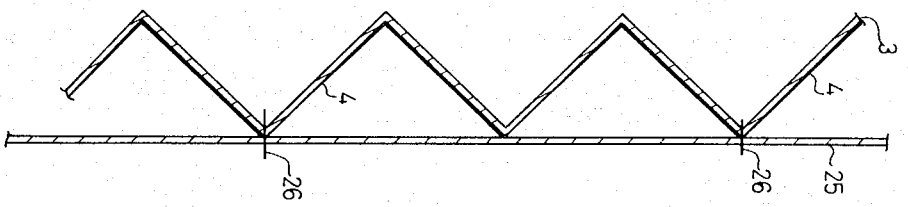
FIGS. 6. and 7 are fragmentary cross-sectional views showing different tapes attached to screen sheets.

According to an embodiment shown in FIG. 6, a pair of tapes 25 (only one shown) are provided at opposite end portions of a screen sheet 3 behind the latter. Each of the tapes 25 is held in contact with folded edges of the pleats 4 and fastened by fasteners 26 such as staples to the folded edges. Although the pleat screen of FIG. 6 is poorer in appearance than the pleat screens according to the previous embodiments, it can be fabricated with more ease.

Figure 7:
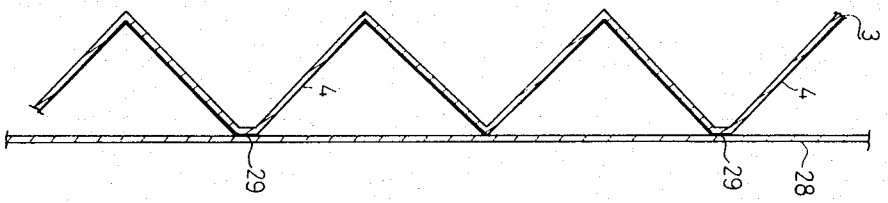

A pleat screen according to an embodiment illustrated in FIG. 7 is substantailly of the same construction as that of the pleat screen of FIG. 6 except that the face of each tape 28 is bonded by an adhesive to folded edges of pleats 4. The pleat screen of FIG. 7 is therefore more sightly in appearance than the pleat screen shown in FIG. 6.

FIG. 8 shows a holder 31 of a square shape which can be employed in place of each of the holders 14 used on the pleat screens illustrated in FIGS. 1 and 4. The holder 31 has a central circular locking tongue 31*a* cut out thereof. The holder 31 attached to a pleat screen renders the latter more attractive in appearance though it is slightly awkward to attach in position.

The pleat screens of the present invention have foldable and unfoldable pleats spaced equally vertically across the pleat screen, with the results that the pleat screens are sightly in appearance and highly resistant to wind pressure.

Although certain preferred embodiments have been shown and described, it should be understood that many changes and modifications may be made therein without departing from the scope of the appended claims. For example, the present invention is applicable to a pleat screen which is not foldable and unfoldable for hanging along a wall.

What is claimed is:

1. A pleat screen having a front side and a back side comprising:

a screen having a plurality of pleats vertically foldable and unfoldable, each of said pleats having an upper portion and a lower portion and each having slits defined therein defining in said screen at least one vertically aligned row of slits;

at least one tape, extending vertically along said screen between the upper and lower ends thereof and extending through said vertically aligned row of slits defined therein, said tape having a plurality of vertically aligned slots defined therein;

holding means acting between selected ones of said pleats and said tape for keeping said plurality of pleats vertically spaced at substantially equal distances, wherein said holding means comprises a plurality of holders attached vertically immovably to said tape in abutment against said lower backs of the selected pleats for supporting, from below, said pleats to thereby prevent the latter from being lowered under their own weight, said holders having locking tongues, each locking tongue being inserted into one of said slots such that said holders are retained on the tape respectively at said slots.

2. A pleat screen according to claim 1, wherein said holders are spaced vertically on said tape at substantially equal intervals and support said selected pleats with an equal number of pleats between each pair of said selected pleats.

3. A pleat screen according to claim 1, including a hanging frame and a bottom frame attached respectively to said upper and lower ends of said screen sheet, and a plurality of lift cords extending vertically through said pleats for folding and unfolding said screen sheet, said tape comprising a plurality of tapes positioned inwardly of said lift cords.

4. A pleat screen according to claim 1, including a hanging frame and a bottom frame attached respectively to said upper and lower ends of said screen sheet, and a pair of lift cords extending vertically through said pleats at horizontal opposite end portions of said screen sheet for folding and unfolding said screen sheet, said tape comprising a single tape positioned between said lift cords in the overlapping ends of said screen sheet members.

* * * * *